United States Patent [19]
Focke
[11] 4,204,630
[45] May 27, 1980

[54] PACKETS FOR CIGARETTES, CIGARILLOS OR THE LIKE

[75] Inventor: Heinz Focke, Verden, Fed. Rep. of Germany

[73] Assignee: Focke & Pfuhl, Verden, Fed. Rep. of Germany

[21] Appl. No.: 691,810

[22] Filed: Jun. 1, 1976

[30] Foreign Application Priority Data

Jun. 11, 1975 [DE] Fed. Rep. of Germany ..... 2525959

[51] Int. Cl.² ..... B65D 5/48
[52] U.S. Cl. ..... 229/15; 229/44 CB; 229/56; 229/87 C
[58] Field of Search ..... 229/44 CB, 87 C, 15, 229/56

[56] References Cited

U.S. PATENT DOCUMENTS

| | | | |
|---|---|---|---|
| 3,025,999 | 3/1962 | Wasyluka | 229/15 |
| 3,662,879 | 5/1972 | Helms | 229/15 |

FOREIGN PATENT DOCUMENTS

| | | | |
|---|---|---|---|
| 739309 | 7/1966 | Canada | 229/44 CB |
| 757927 | 5/1967 | Canada | 206/45.14 |
| 77590 | of 1949 | Czechoslovakia | 229/44 CB |
| 102424 | of 1916 | United Kingdom | 229/15 |
| 789627 | of 1958 | United Kingdom | 229/44 CB |
| 218051 | of 1968 | U.S.S.R. | 229/15 |

*Primary Examiner*—Joseph Man-Fu Moy
*Attorney, Agent, or Firm*—Sughrue, Rothwell, Mion, Zinn and Macpeak

[57] ABSTRACT

A lateral partition is partially punched out of a planar insert which may be folded into transverse position when the insert is inserted along one sidewall of a cigarette packet.

2 Claims, 4 Drawing Figures

PACKETS FOR CIGARETTES, CIGARILLOS OR THE LIKE

Figure 1:
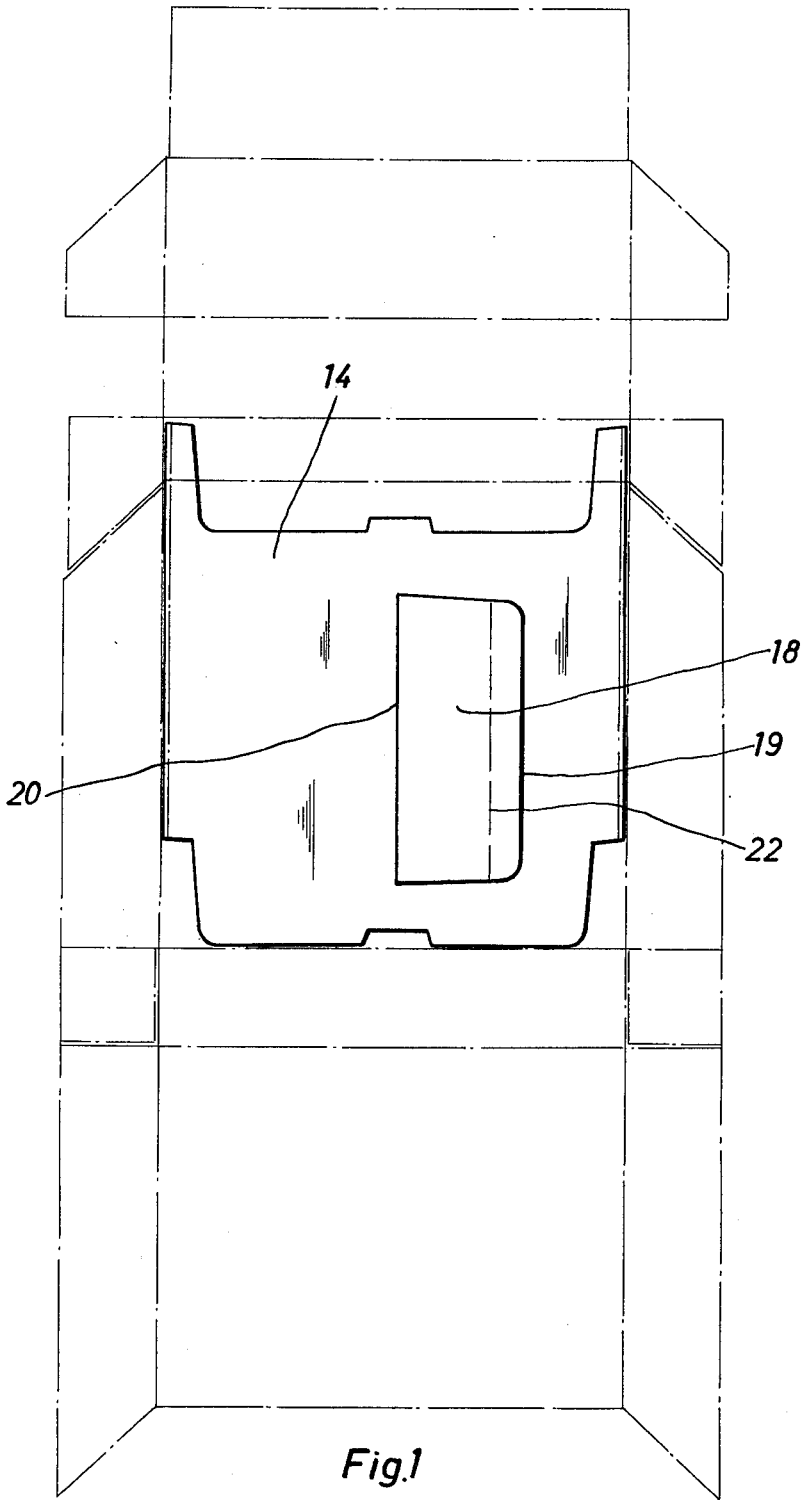

This invention relates to a packet for cigarettes, cigarillos or the like, more particularly a hardbox packet, having a blank of relatively rigid material, an insert (collar) attached to the blank, and also an inner partition to subdivide the packet into two component spaces.

The cigarette packets to which the invention mainly relates are also known as hinged-lid packets. An outer blank of relatively rigid cardboard or pasteboard forms a hinged cover which, in the closure position, encloses in the zone of the front wall and the side walls of the pack an insert (collar) inserted thereinto. The collar is conventionally a separate blank which is inserted into the packet during its manufacture or is attached to the blank forming the packet.

The packets specified are mainly intended to receive a group or block of cigarettes, with a tinfoil wrapping. However, double packets of this construction are also known which contain two separate groups of cigarettes, each with its own tinfoil wrapping. The two groups of cigarettes are separated from one another by a partition which subdivides the packet into two component spaces. In one prior art packet of the kind specified, the partition is formed by a separate blank part of Z or double T cross-section. Via the flanges with which the blank of this kind is formed, the partition is attached by glueing to the inside of the front rear wall of the back and the insert.

It is an object of the present invention to provide a packet for cigarettes and the like, more particularly a hardbox pack, which has a partition for forming component spaces in the packet, and which, due to its special design, can be more simply manufactured and can require less material than prior art packets of the kind specified.

According to the present invention there is provided a packet for cigarettes, cigarillos, or the like, more particularly a hardbox packet, which packet comprises a blank of relatively rigid material, an insert (collar) attached to the blank, and also an inner partition to subdivide the pack into two component spaces, the partition taking the form of part of the packet, more particularly part of the insert (collar).

Preferably the partition is part of the insert (collar). More particularly, the partition is formed by punching it out of the insert, maintaining a residual connection, and folding it upwardly into a transverse position. The insert (collar) is, therefore, at the same time a part of the packet forming the partition. No special separate blank is, therefore, required for the partition. The punching to form the partition is normally substantially U-shaped. The residual connection to the insert is formed by a pivoting axis lying in the central transverse plane of the packet. The partition is folded upwardly around the pivoting axis into a position extending transversely into the pack. The free edge of the partition remote from such pivoting axis is conveniently connected to the opposite wall of the pack, more particularly via an edge flap glued or welded on or attached in some other manner.

Figure 2:
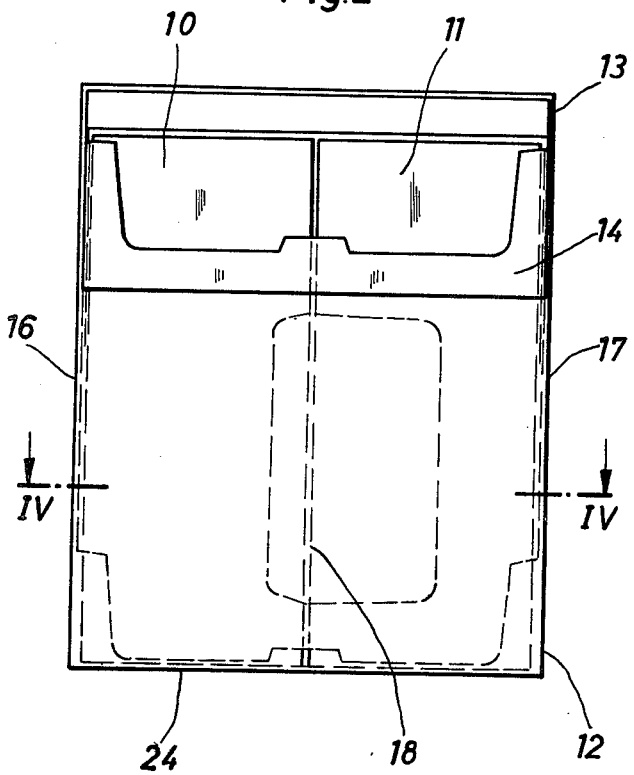
Figure 3:
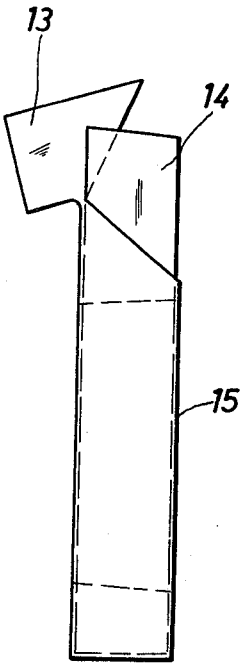
Figure 4:
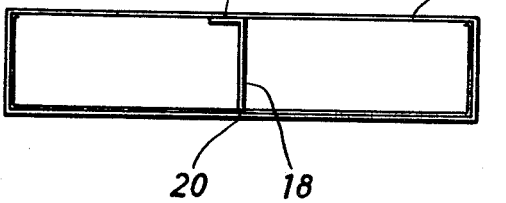

For a better understanding of the present invention and to show how the same may be put into effect, reference will now be made, by way of example, to the accompanying drawings, in which:

FIG. 1 shows a spread out blank for making a hardbox packet, with an applied special blank for an insert (collar), FIG. 2 shows a front view of a pack according to the invention in the opened condition, FIG. 3 shows a side view corresponding to FIG. 2, and FIG. 4 shows a horizontal sectional view, taken along the line IV—IV, of the packet of FIG. 2.

The packet illustrated is intended for cigarettes, mainly to receive two separate groups 10 and 11 of cigarettes each in a tin foil wrapping. The packet consists of an outer blank or wrapping 12 of relatively rigid material, such as cardboard, pasteboard or the like. The general design of this one-part blank 12 shown in FIG. 1 is known in principle. In the finished packet, this blank forms a hinged cover 13 engaging in the closure position around an insert 14 (collar).

The insert 14 is a separate blank part which in the finished packet bears against the inside of three sides thereof, namely front wall 15 and side walls 16 and 17. At the top, the insert 14 extends out of the zone of the walls 15 to 17, shortened by the dimensions of the hinged cover 13.

The packet, which receives two groups 10 and 11 of cigarettes, has a central partition extending in the finished pack between the two groups 10 and 11 of cigarettes.

The partition 18 is part of the insert 14. It is so formed by a U-shaped punching line 19 in the blank for the insert 14 that the partition 18 remains connected to the insert 14 via a residual connection outside the punching line 19. In this zone, there extends a conveniently pre-embossed central pivoting axis 20. The partition 18 is pivoted outwardly around the axis 20 into a position transverse of the insert 14 (see FIG. 4). A corresponding recess is left in the insert 14.

The punched-out partition 18 is of dimensions such that, on the edge opposite the axis 20, there is formed an edge flap 21 which can be pivoted downwardly and is conveniently pre-marked by a folding line 22. The edge flap 21 is connected to an opposite rear wall 23 of the packet.

In this embodiment, the insert 14 is of dimensions such that it extends as far as the end 24 of the packet, the result being an adequate constructional height for the formation of a correspondingly high partition 18.

What I claim is:

1. In a hard box packet for cigarettes, cigarillos, or the like, made from a blank of relatively rigid material, said packet having a folding lid, an insert attached to the blank, and an inner partition formed by said insert to subdivide the pack into two component spaces, said insert having a collar portion adapted to engage said folding lid, the improvements comprising: the partition being attached to the insert on one of its sides and having an edge flap opposite the side of attachment, said subdivision being formed by punching said partition from said insert and folding it into a position transverse of said insert, said edge flap abutting a wall of said packet opposite said insert and being attached to said opposite packet wall by gluing, welding or the like.

2. A packet according to claim 1, wherein the insert extends to the bottom of the packet.

* * * * *